US006619520B2

(12) United States Patent
Hammond

(10) Patent No.: US 6,619,520 B2
(45) Date of Patent: Sep. 16, 2003

(54) HANDS-FREE UMBRELLA SUPPORTING BAG

(76) Inventor: Deborah Hammond, 7700 Rollingridge Ct., Orlando, FL (US) 32835

( * ) Notice: Subject to any disclaimer, the term of this patent is extended or adjusted under 35 U.S.C. 154(b) by 56 days.

(21) Appl. No.: 09/804,855

(22) Filed: Mar. 13, 2001

(65) Prior Publication Data

US 2001/0040177 A1 Nov. 15, 2001

Related U.S. Application Data

(60) Provisional application No. 60/188,775, filed on Mar. 13, 2000.

(51) Int. Cl.[7] ..... A45B 11/02
(52) U.S. Cl. ..... 224/188; 224/915
(58) Field of Search ..... 224/188, 160, 224/153, 185, 623, 625, 915, 576

(56) References Cited

U.S. PATENT DOCUMENTS 4,537,339 A * 8/1985 Pearson ..... 224/186
5,004,134 A * 4/1991 Barry ..... 224/235
5,878,761 A * 3/1999 Vadher ..... 135/16
5,887,771 A * 3/1999 Perry ..... 224/190
5,918,612 A * 7/1999 Hughes ..... 135/16
6,024,464 A * 2/2000 De Vera ..... 224/190
6,053,385 A * 4/2000 Ward et al. ..... 224/153

* cited by examiner

*Primary Examiner*—Stephen K. Cronin
*Assistant Examiner*—Lien Ngo
(74) *Attorney, Agent, or Firm*—Law Offices of Royal W. Craig

(57) ABSTRACT

A hands-free carry-bag/umbrella sling with a frontally-disposed receptacle and rearward support harness. The support harness comprises a broad three-strap wishbone support for holding a significant load and the umbrella securely against the body. The frontal receptacle is sized to carry a considerable payload, and it includes a pocket for receiving the handle of any conventional umbrella, inclusive of curved handles. A support that is sewn into the carry-bag/umbrella sling supports the shaft of the umbrella. The particularly configured shape provides a snug fit, yet the carry-bag provides for quick and easy deployment and removal. The free-hanging design safely and securely holds any size umbrella in its open configuration. Moreover, when the carry-bag is not in use, its particularly configured paneled structure easily collapses and folds for storage.

7 Claims, 6 Drawing Sheets

HANDS-FREE UMBRELLA SUPPORTING BAG

CROSS-REFERENCE TO RELATED APPLICATIONS

The present application derives priority from U.S. Provisional Patent Application No. 60/188,775 for "HANDS-FREE UMBRELLA SUPPORTING BAG" filed Mar. 13, 2000.

BACKGROUND OF THE INVENTION

1. Field of the Invention

The present invention relates to carry bags and, more particularly, to an economical hands-free carry bag with integral adjustable umbrella sling for hands-free support of an open umbrella.

2. Description of the Background

The use of an umbrella generally requires at least one hand. Consequently, there are many instances such as when carrying groceries to one's car when the use of an umbrella is just not possible. Even with a free hand it is difficult to hold an umbrella for a long period of time because it eventually gets tiresome. In these and many other situations, it is desirable to provide a hands-free support for an umbrella. However, the great variety of umbrellas has led to a great variety of possible supporting configurations, many of which are simply not economically feasible.

U.S. Pat. No. 5,918,612 to Hughes shows a simple umbrella carry strap with belt and shoulder strap.

U.S. Pat. No. 5,878,761 to Vadher shows an umbrella holding harness for a pop-up umbrella. The umbrella is held in a carrying case that is supported about the neck. The supporting straps include a belt, a front-to-back shoulder strap attached to the belt, and a back-to-belt support strap for stability. A single, elongate Velcro closure flap holds the umbrella.

U.S. Pat. No. 5,513,786 to Drane shows an umbrella holder which straps to an individual's torso via a belt and adjustable shoulder strap which crosses the back and chest of the user at an oblique angle. A support strap for securing the umbrella to the harness extends perpendicular from the belt and engages the shoulder strap. Tie-downs hold the umbrella in position on the support.

U.S. Pat. No. 4,537,339 to Pearson shows an umbrella support that can accommodate a curved or straight handle of a short or long umbrella shaft. The support is mounted on the front or back of a user's body via a thick shoulder strap and belt. Leather tie-downs secure the umbrella.

While the basic concept of an umbrella harness is well known as shown by all of the above-referenced U.S. Patents, most of these are fairly complex, difficult to put on, uncomfortable to wear, and very expensive to manufacture. It would be greatly advantageous to provide a hands-free carry bag with integral umbrella sling that can be cut and sewn from a simple fabric pattern design, which is very comfortable to wear even when supporting a load such as groceries, and yet which can provide a steadfast support for an open umbrella even under unsteady conditions.

SUMMARY OF THE INVENTION

It is, therefore, an object of the present invention to provide a hands-free carry bag with integral carry-pouch that employs a broad front-to-back shoulder harness for added comfort and stability.

It is another object to provide a hands-free carry bag as described above that is easy to put on, and with an integral umbrella sling that is easy to use.

It is a further object to greatly reduce manufacturing costs with a pattern design that yields an economical and yet comfortable, durable and steady harness.

It is another object to provide a combination carry-bag/umbrella sling that is particularly configured to safely and securely hold any size of umbrella in its open configuration.

It is still another object to provide a hands-free carry-bag/umbrella sling that knocks down to a compact configuration for convenient and unobtrusive storage in the trunk, passenger compartment, or even in one's pocket.

It is still another object to provide a hands-free carry-bag/umbrella sling with a frontally-disposed receptacle and rearward support harness capable of balanced and comfortable frontal support of a significant load.

According to the present invention, the above-described and other objects are accomplished by providing a hands-free carry-bag/umbrella sling with a frontally-disposed receptacle and rearward support harness. The support harness comprises a broad three-strap support for holding a load and the umbrella securely against the body. Moreover, the harness configuration includes a wide-ranging adjustable shoulder strap that can fit adults as well as children.

The frontal receptacle is sized to carry a significant load, and it includes a pocket for receiving the handle of any conventional umbrella, inclusive of curved handles.

A raised hook and loop (e.g. Velcro) closure/fastener that is sewn into the carry-bag supports the neck of the umbrella. The patterned panel-cut design of the present invention is highly economical and greatly simplifies manufacturing.

The carry-bag is cut and sewn from a durable material (i.e. vinyl fabric, vinyl backed woven polyester fabric, canvas, leather, etc.), and has a tailored body-hugging shape that is particularly configured for comfort under load.

To wear the hands-free carry-bag/umbrella sling, the harness is looped about the neck. It has an offset vertical pouch for insertion of an umbrella. The hands remain free, for example, to (1) carry other things such as groceries, (2) walk the dog(s), (3) carry a baby carrier. The particularly configured shape provides a snug fit, yet the carry-bag provides for quick and easy deployment and removal. When the carry-bag is not in use, its particularly configured paneled structure easily collapses and folds for storage.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
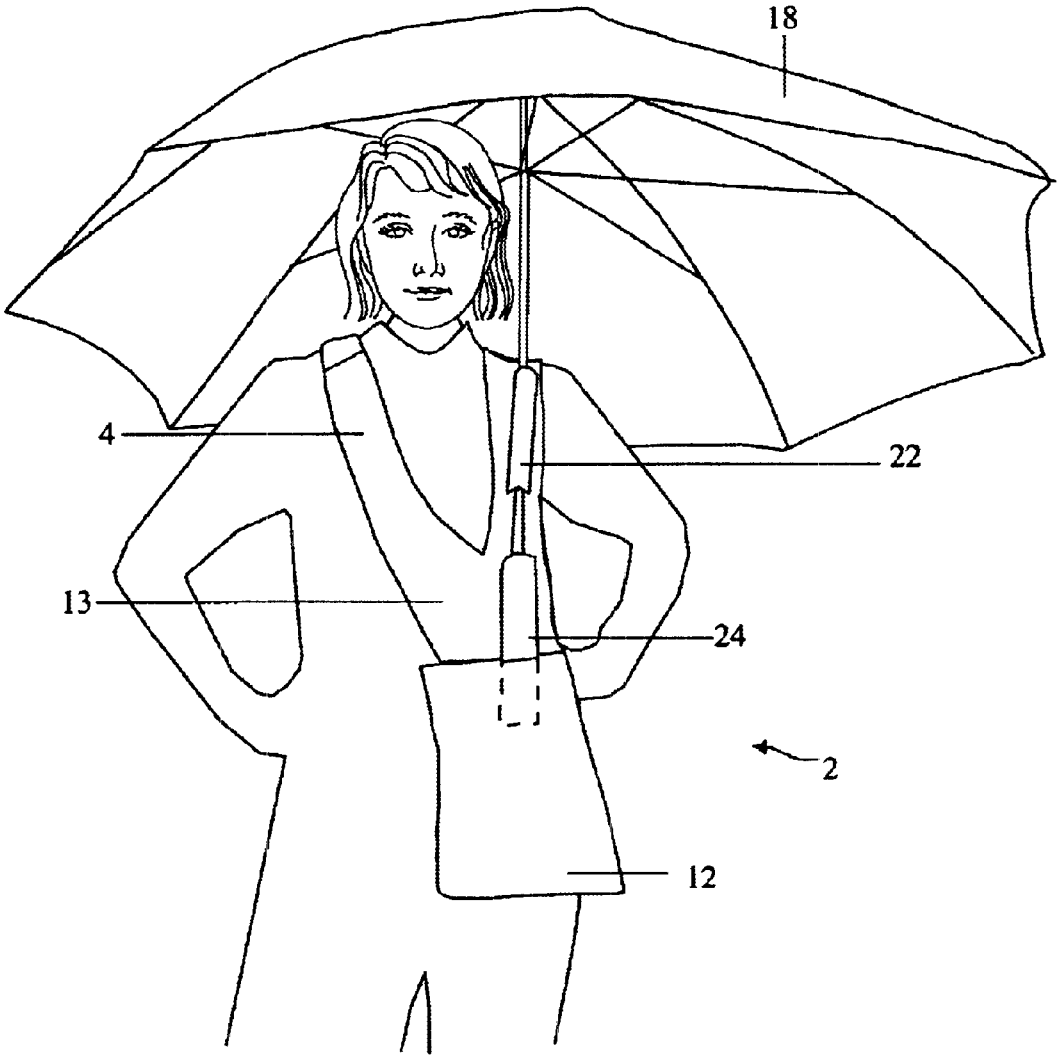
FIG. 1 is a front perspective view of the hands-free carry-bag/umbrella sling 2, as worn by an adult, according to a first embodiment of the present invention.

FIG. 1 is a front perspective view of the hands-free carry-bag/umbrella sling 2, as worn by an adult, according to a first embodiment of the present invention.

The hands-free carry-bag/umbrella sling 2 possesses a frontally-disposed receptacle 12 and shoulder support harness 13. The support harness 13 comprises a unique triple-strap support for holding a considerable load while simultaneously holding a conventional umbrella 18 securely against the body. Moreover, the support harness 13 includes a wide-ranging adjustable shoulder strap 14 that can fit adults as well as children.

The frontally-disposed receptacle 12 is sized to carry a significant load while simultaneously securing the handle of any conventional umbrella, inclusive of curved handle varieties. An umbrella handle receptacle 24 is sewn to both support harness 13 and an inside surface of receptacle 12 for this purpose.

An umbrella shaft support 22 is sewn to the outside of the shoulder support harness 13 to adjustably support the shaft of the umbrella 18.

Figure 2:
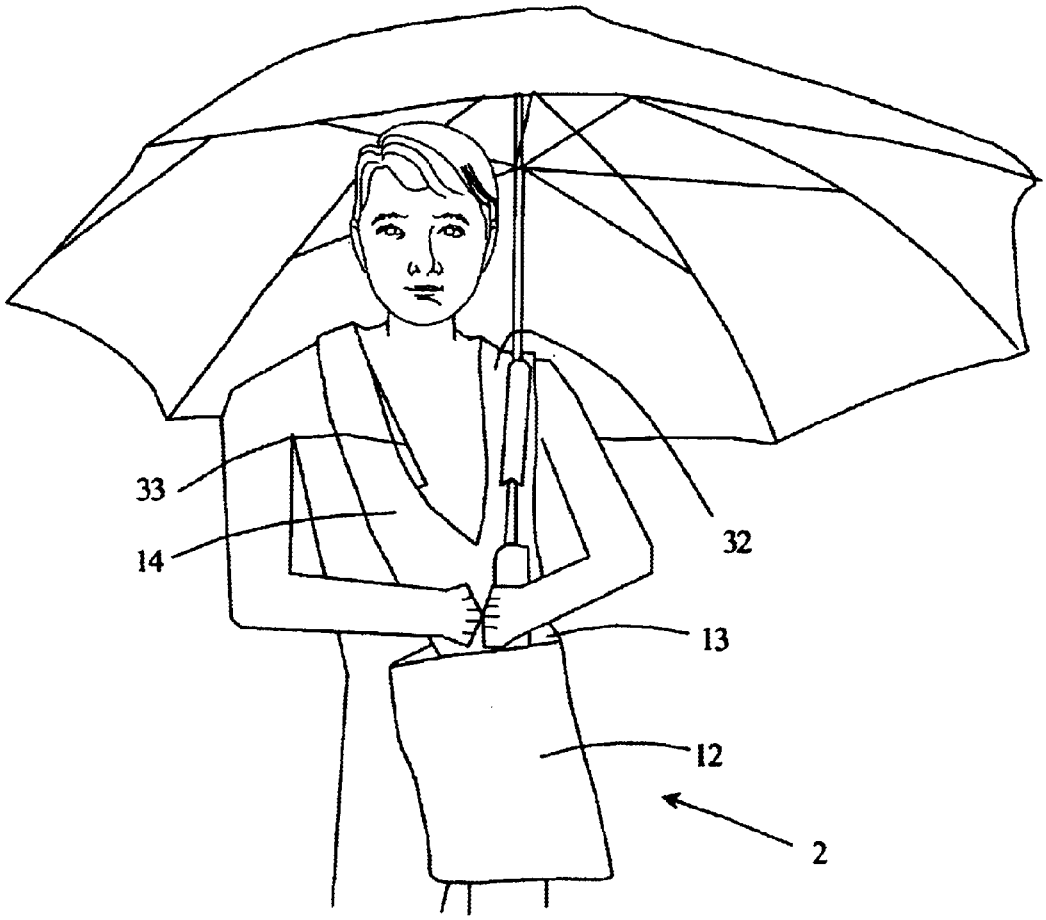
FIG. 2 is a front perspective view of the hands-free carry-bag/umbrella sling 2, according to a first embodiment of the present invention, as worn by a child to illustrate its wide-ranging size adjustment capability.

FIG. 2 is a front perspective view of the hands-free carry-bag/umbrella sling 2 according to a first embodiment of the present invention, as worn by a child to illustrate its wide-ranging size adjustment capability. This is accomplished by virtue of two features. First of all, the wide-ranging adjustable shoulder strap 14 of shoulder support harness 13 is releasably anchored along an overlapping neck closure section 33 of left shoulder wishbone strap 32. Second, the harness 13 is carefully designed to support the receptacle 12 comfortably against the pelvis, offset slightly to the wearer's left and recessed in the hollow of the hip. This is important as will become apparent for sturdy support of the umbrella shaft.

Figure 3:
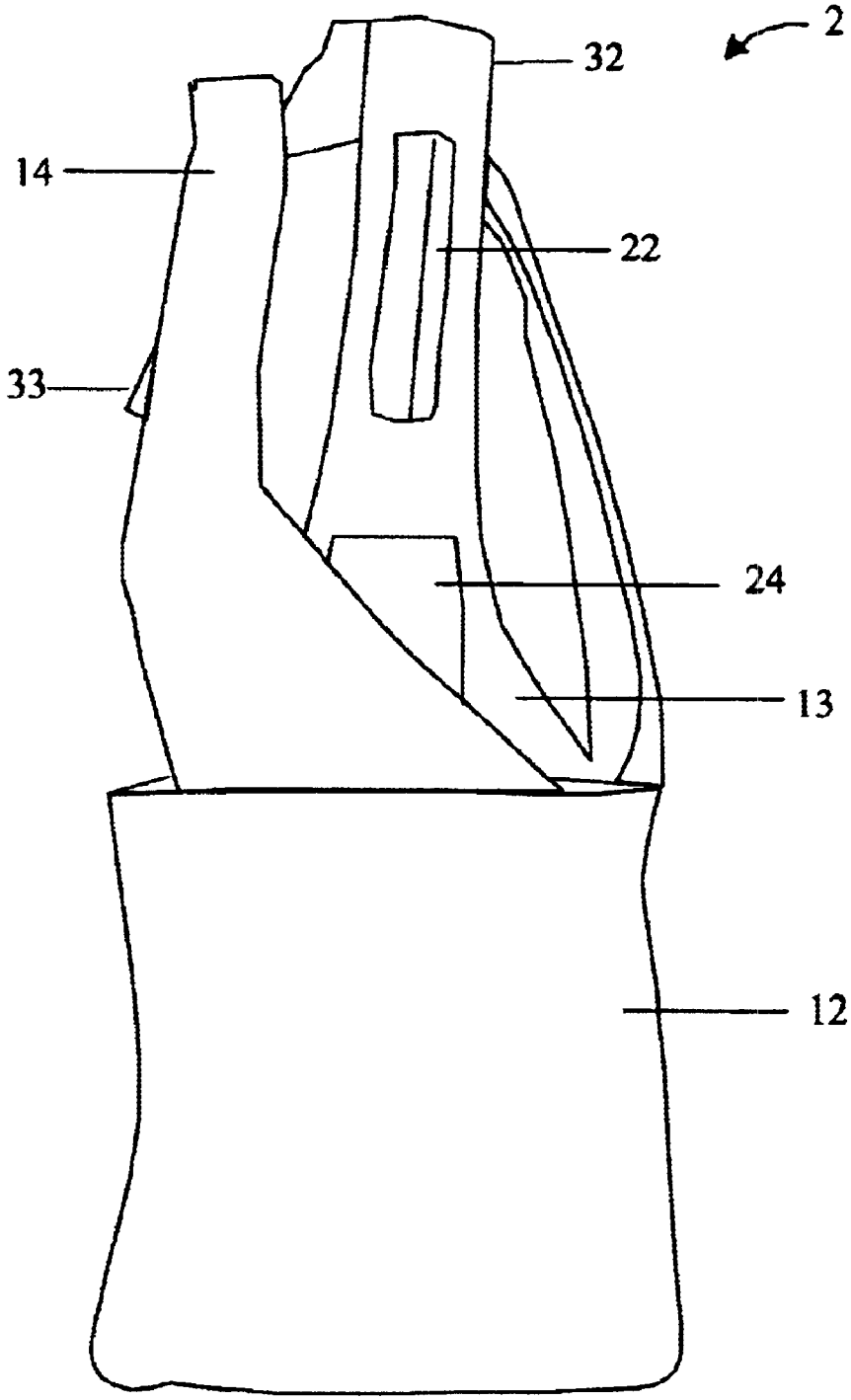
FIG. 3 is a close-up front perspective view of the hands-free carry-bag/umbrella sling 2 according to a first embodiment of the present invention showing the wide-ranging adjustable shoulder strap 14 and the left shoulder wishbone strap 32 in the closed position.
Figure 4:
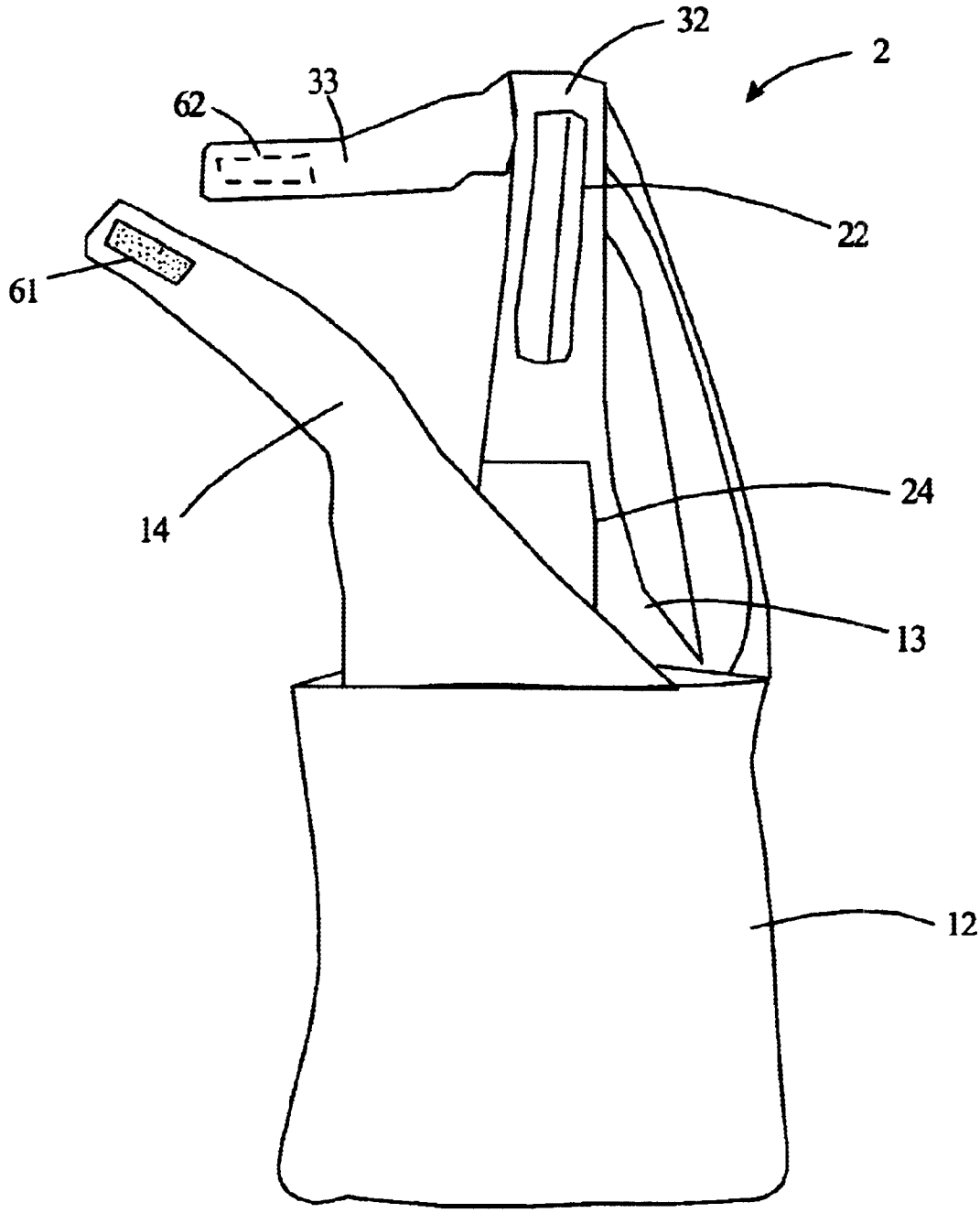
FIG. 4 is a close-up front perspective view of the hands-free carry-bag/umbrella sling 2 according to a first embodiment of the present invention showing the wide-ranging adjustable shoulder strap 14 and the left shoulder wishbone strap 32 in the open position.

FIGS. 3 and 4 are close-up front perspective views of the hands-free carry-bag/umbrella sling 2 according to a first embodiment of the present invention showing the wide-ranging adjustable shoulder strap 14 and the left shoulder wishbone strap 32, respectively, in the closed and open positions. These two figures collectively show the configuration of the shoulder support harness 13, inclusive of the adjustable shoulder strap 14 attached to underlying neck closure section 33 of left shoulder wishbone strap 32. Generally, the wishbone strap 32 is a wishbone-section of material with a flared end sewn into the back of receptacle 12. An umbrella handle receptacle 24 is formed by a fabric panel sewn to the front of wishbone strap 32 and downward inside receptacle 12, thereby forming a pouch having an upwardly-disposed open end, as shown, to support the handle of an umbrella when inserted therein. This particular construction whereby umbrella handle receptacle 24 is sewn across the junction of the wishbone strap 32 and receptacle 12 greatly increases the integrity of the junction seam. The opposing end of wishbone strap 32 is sewn around the inner right side of the receptacle 12. An adjustable shoulder strap 14 is likewise formed with a flared end sewn into the front of receptacle 12. The free end of adjustable shoulder strap 14 reaches upward toward the right shoulder of a wearer for overlapping attachment to the free end of wishbone strap 32. An elongate strip of hook and loop closure/fastener 61 is sewn along the inside of the adjustable shoulder strap 14, and a corresponding strip of closure/fastener 62 is sewn along the outside of the free end of wishbone strap 32 for this purpose. As can be seen, the umbrella shaft support 22 comprises a rectangular panel of material with the mid-section sewn lengthwise along the wishbone strap 32. This leaves opposing flaps which can be closed over on themselves. Hook and loop closure/fastener is sewn along both flaps of support 22 to allow them to be releasably locked around the shaft of an umbrella.

In order to wear the hands-free carry-bag/umbrella sling 2, the wishbone strap 32 is looped over the left shoulder with the receptacle 12 dangling freely in front of the wearer. The user's left arm is inserted through the loop of the wishbone strap 32. The free end of adjustable shoulder strap 14 is brought upward and the hook and loop closure/fastener 61 thereon is secured to the corresponding closure/fastener 62 on the free end of wishbone strap 32. Since the degree of overlap between the free end of wishbone strap 32 and the free end of the adjustable shoulder strap 14 is variable to a significant extent, the wearer may adjust the closures/fasteners 61, 62 so that the receptacle 12 dangles comfortably and unobtrusively against the pelvis. This configuration is carefully designed to position the receptacle 12 offset slightly to the wearer's left side and recessed in the hollow of the left hip. This is important because when the umbrella handle is seated in the receptacle 24, its shaft will follow the line of the wearer's body from the shoulder down to the groin. In this position, the umbrella will remain securely and comfortably seated against the body even during periods of jarring movement. The wearer's hands remain free to carry things such as a baby carrier or groceries, or to perform chores such walking the dog(s). The particularly configured shape of the harness 13 inclusive of the wishbone strap 32 provides a snug fit, yet the carry-bag/umbrella sling 2 can be quickly and easily removed and stored. In fact, the unique all-fabric construction of the carry-bag/umbrella sling 2 makes it easy to collapse and fold for storage in a glove compartment, trunk or even in a pant pocket.

An exemplary pattern cut for the carry-bag/umbrella sling 2 will now be described with reference to FIGS. 5 and 6.

Figure 5:
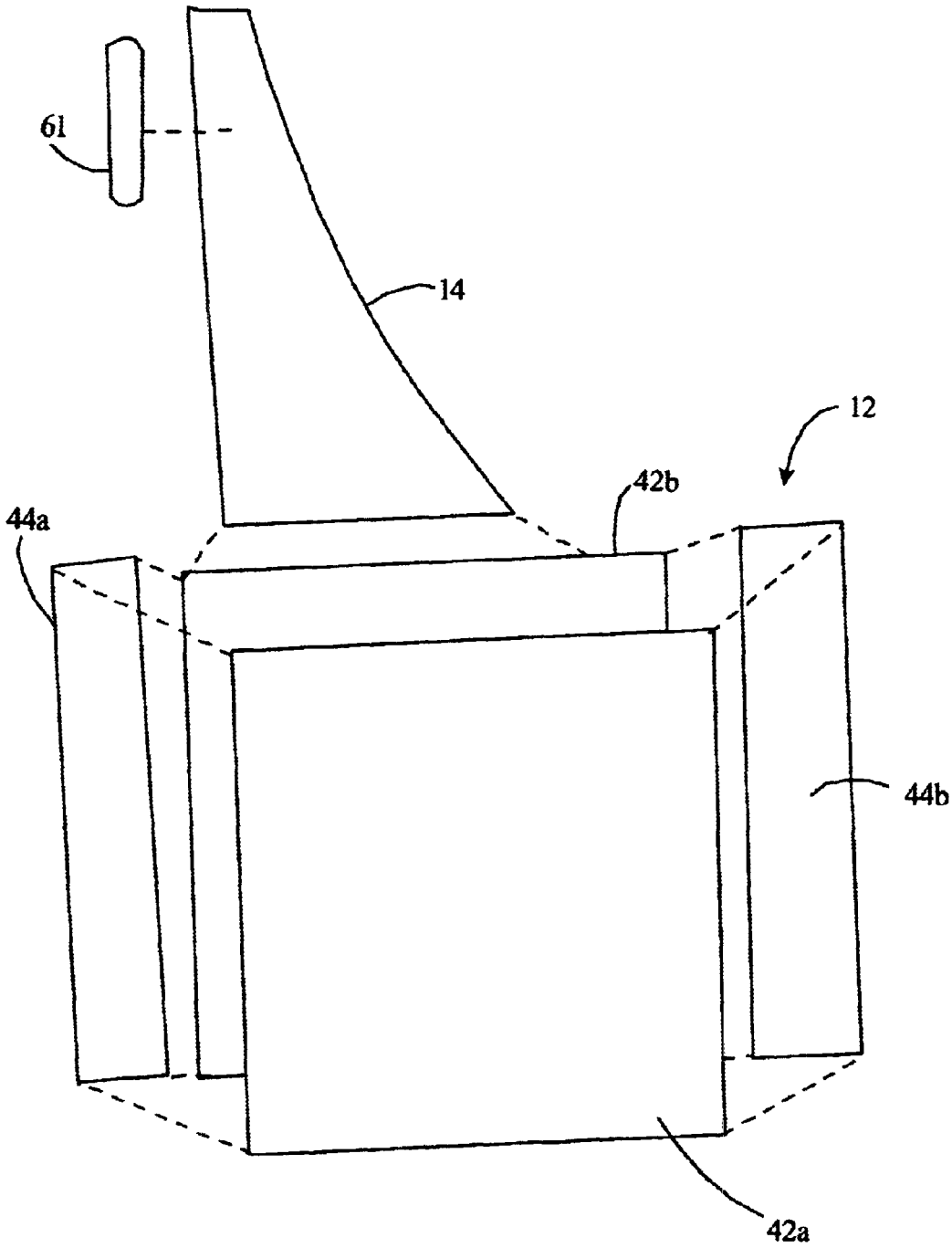
FIG. 5 is a front pattern view of the receptacle panels 42*a,* 42*b,* 44*a,* 44*b* and right shoulder strap 14 of the hands-free carry-bag/umbrella sling 2 according to a first embodiment of the present invention.

FIG. 5 is a front pattern view of the receptacle panels 42*a,* 42*b,* 44*a,* 44*b* and right shoulder strap 14 of the hands-free carry-bag/umbrella sling 2 according to a first embodiment of the present invention. This pattern design according to the present invention is highly economical and greatly simplifies manufacturing. The receptacle 12 preferably comprises a five-paneled structure inclusive of front and back panels 42*a,* 42*b,* respectively. Opposing side panels 44*a,* 44*b* are sewn along the sides of front and back panels 42*a,* 42*b*. In addition, a bottom panel (not shown in FIG. 5) is sewn along the front and back panels 42*a,* 42*b*. Alternatively, the front and back panels 42*a,* 42*b* may be formed as one elongate vertical rectangular panel that is doubled over to eliminate the need for a bottom panel. Alternatively, the front and back panels 42*a,* 42*b* may be formed as one elongate horizontal rectangular panel that is looped around and sewn onto itself, thereby eliminating the need for separate side panels 44*a,* 44*b*. In any of the above cases, the adjustable right shoulder strap 14 is flared toward the bottom, and the flared section is sewn to the front panel 42*a* of the receptacle 12. An elongate strip of hook and loop closure/fastener 61 is sewn inside the free end of the adjustable right shoulder strap 14.

The foregoing and all other panels of the carry-bag/umbrella sling 2 are preferably cut and sewn from a durable material (e.g. vinyl fabric, vinyl backed woven polyester fabric, leather), and each panel may be doubled for reinforcement. The resulting all-fabric construction gives a tailored body-hugging shape that is particularly configured for comfort under load.

Figure 6:
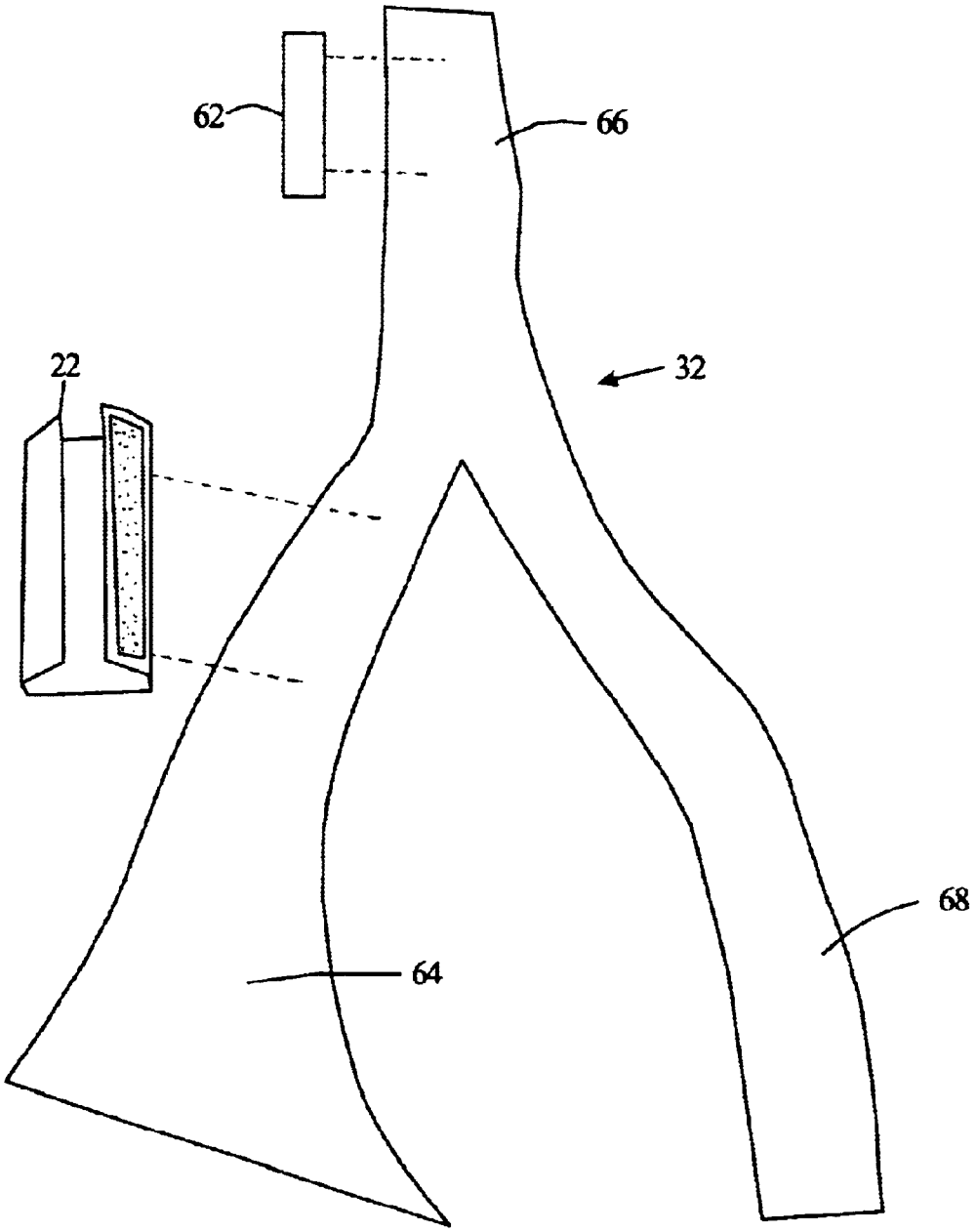
FIG. 6 is a front pattern view of the left shoulder wishbone strap 32 and umbrella neck closure 34 of the hands-free carry-bag/umbrella sling 2 according to a first embodiment of the present invention.

FIG. 6 is a front pattern view of the left-shoulder wishbone strap 32 and umbrella shaft support 22 of the carry-bag/umbrella sling 2 according to a first embodiment of the present invention. The wishbone strap 32 includes a substantially straight right support strap 68, a flared left section 64 (to be sewn to the back panel 42*b* of the receptacle 12), and a free end 66 (that mates with the adjustable right shoulder strap 14), all three of the foregoing sections coming together at a junction to form the wishbone configuration.

As can be seen, an elongate strip of hook and loop closure/fastener 62 is sewn inside the free end 66 of the wishbone strap 32, and the umbrella neck support 22 is sewn directly to the face of the flared left section 64 of wishbone strap 32. When worn by a user, the above-described configuration of harness 13 and especially the wishbone strap 32 gives triple load-bearing support against both shoulders as well as around the back of the neck. When it is no longer needed, the device's particularly configured structure easily collapses and folds for storage.

The broad front-to-back shoulder support gives comfort and stability, yet it is easy to put on and the integral umbrella sling is easy to use. The all-fabric panel construction greatly reduces manufacturing costs, yet the free-hanging design safely and securely holds any size umbrella in its open configuration. Moreover, the frontally-disposed receptacle 12 is capable of balanced and comfortable frontal support of a significant load.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A hands-free carry-bag/umbrella sling, comprising:

a frontally-disposed receptacle;

a shoulder support harness for supporting said frontally-disposed receptacle about the neck and shoulders of a user, said support harness further comprising, a wishbone strap having three ends including a first end and a second end both attached to said frontally-disposed receptacle to form a loop for support about one of the user's shoulders, and a third free end bearing a first fastener, and an adjustable shoulder strap extending from the frontally-disposed receptacle at an angle relative thereto to a free end bearing a second fastener for attachment to the first fastener on the third free end of the wishbone strap, wherein attachment of said first fastener to said second fastener about the other of the user's shoulders that positions said frontally-disposed receptacle against the user's pelvis;

an umbrella shaft support attached to the first end of the wishbone strap for supporting an umbrella shaft; and an umbrella handle receptacle attached to the first end of the wishbone strap and to an inside surface of said frontally-disposed receptacle for supporting an umbrella handle.

2. The hands-free carry-bag/umbrella sling according to claim 1, wherein said frontally-disposed receptacle, shoulder support harness, umbrella shaft support, and umbrella handle receptacle comprise any one material from among the group comprising vinyl fabric, vinyl backed woven polyester fabric, canvas, and leather.

3. The hands-free carry-bag/umbrella sling according to claim 2, wherein said frontally-disposed receptacle is formed from five separate panels of said material, including a front panel, a back panel, a bottom panel, and opposing side panels, sewn together.

4. The hands-free carry-bag/umbrella sling according to claim 2, wherein said frontally-disposed receptacle is formed from three separate panels of said material, including two opposing side panels and a doubled-over single panel, sewn together.

5. The hands-free carry-bag/umbrella sling according to claim 2, wherein said frontally-disposed receptacle is formed from two separate panels of said material, including a bottom panel, and a single panel that is looped around and sewn end-to-end, thereby forming front, back, and sides of said receptacle.

6. The hands-free carry-bag/umbrella sling according to claim 1, wherein said umbrella shaft support further comprises a rectangular panel of material sewn lengthwise along a mid-section to of the first end of said wishbone strap to leave opposing flaps free to be closed over on themselves, said opposing flaps having fasteners sewn lengthwise to allow them to be releasably locked around the shaft of an umbrella, whereby the umbrella shaft is held against the body of the user.

7. The hands-free carry-bag/umbrella sling according to claim 1, wherein the first fastener on the third free end of said wishbone supporting strap and the second fastener on the free end of the adjustable shoulder supporting strap are adjustably fastened together for size variations to allow said carry bag/umbrella sling to be comfortably worn by individuals ranging from children to full grown adults.

* * * * *